US008756713B2

(12) United States Patent
Fu

(10) Patent No.: US 8,756,713 B2
(45) Date of Patent: Jun. 24, 2014

(54) HOODIE WITH THREE GROUPS OF CONNECTORS ON AN OPENING EDGE OF THE HOOD

(76) Inventor: Yiping Fu, Overland Park, KS (US)

( * ) Notice: Subject to any disclaimer, the term of this patent is extended or adjusted under 35 U.S.C. 154(b) by 0 days.

(21) Appl. No.: 13/111,881

(22) Filed: May 19, 2011

(65) Prior Publication Data

US 2012/0291178 A1 Nov. 22, 2012

(51) Int. Cl.
*A41D 13/11* (2006.01)
*A41D 27/00* (2006.01)

(52) U.S. Cl.
CPC ..... *A41D 27/00* (2013.01); *A41D 13/1153* (2013.01)
USPC ..... 2/84; 2/202; 2/206

(58) Field of Classification Search
USPC ..... 2/84, 202–204
See application file for complete search history.

(56) References Cited

U.S. PATENT DOCUMENTS 3,968,521 A * 7/1976 Bashlow ..... 2/203
4,038,698 A * 8/1977 Smith ..... 2/79
4,573,217 A * 3/1986 Reed ..... 2/7
4,671,775 A * 6/1987 Hill ..... 441/124
4,768,235 A * 9/1988 Webster ..... 2/205
5,251,336 A * 10/1993 Nevins ..... 2/202
5,274,850 A * 1/1994 Aldridge ..... 2/84
5,575,009 A * 11/1996 Ryvin ..... 2/173
5,815,833 A * 10/1998 Kuo ..... 2/69.5
5,832,538 A * 11/1998 Williams ..... 2/202
5,845,340 A * 12/1998 Frislie ..... 2/202
5,873,132 A * 2/1999 Grilliot et al. ..... 2/84
5,991,921 A * 11/1999 Saito ..... 2/69
6,266,828 B1 * 7/2001 Corsini ..... 2/424
6,374,418 B1 * 4/2002 Rindle ..... 2/202
6,654,963 B2 * 12/2003 Fayle et al. ..... 2/84
6,687,919 B2 * 2/2004 Dilworth et al. ..... 2/457
7,823,222 B2 * 11/2010 Grilliot et al. ..... 2/202
8,037,547 B2 * 10/2011 Duncan ..... 2/410
2005/0193472 A1 * 9/2005 Courtney et al. ..... 2/202
2006/0117470 A1 * 6/2006 Hofmann ..... 2/457
2006/0288465 A1 * 12/2006 Delorenzo et al. ..... 2/84
2007/0118960 A1 * 5/2007 Goodwin ..... 2/84
2007/0266473 A1 * 11/2007 Issel ..... 2/84
2008/0196145 A1 * 8/2008 Grilliot et al. ..... 2/202
2008/0196146 A1 * 8/2008 Grilliot et al. ..... 2/202
2008/0201821 A1 * 8/2008 Bryant ..... 2/84
2009/0031472 A1 * 2/2009 Gandy ..... 2/84
2009/0205096 A1 * 8/2009 Seemann ..... 2/4
2010/0064417 A1 * 3/2010 Fruge ..... 2/202
2010/0078457 A1 * 4/2010 Pitchford et al. ..... 224/576
2010/0170024 A1 * 7/2010 Seter ..... 2/84
2010/0325771 A1 * 12/2010 Gandy ..... 2/84
2012/0266350 A1 * 10/2012 Zack ..... 2/84

* cited by examiner

*Primary Examiner* — Bobby Muromoto, Jr.
(74) *Attorney, Agent, or Firm* — Studebaker & Brackett PC

(57) ABSTRACT

A garment with a hood, wherein three groups of connectors are installed on and around the opening edge of the hood surrounding the face of the wearer. Each group of the three groups of connectors are positioned at a vertex of a triangle shape. When the hood has been put on the head of the wearer, the exposure area of the wearer's face is to be adjusted to be smaller or larger, by tightening or untightening one pair, or more than one pair of the connectors. When tightened, the hood forms better thermo-insulation, and provides better protection for the user against severe weather including cold, wind and snow.

4 Claims, 3 Drawing Sheets

HOODIE WITH THREE GROUPS OF CONNECTORS ON AN OPENING EDGE OF THE HOOD

BACKGROUND

Hoodie: the term hoodie, here means an article of clothing that comes with a hood. A traditional definition includes a hooded sweatshirt, jacket, or other upper garment. The traditional design includes a drawstring, to adjust the hood opening. The hood is to be used to cover the head of the user, making the head partly enclosed, but leave the face exposed to the outside.

User: the term user or individual, has the same meaning as a wearer, with the hood put on his/her head or not on the head.

Today, hoods are generally soft head coverings which form part of a larger garment, the hoodie. They can be pulled up over the head when needed, or left to hang down the back when not. They may also be detachable to turn a winter overcoat into a summer one.

FIELD OF THE INVENTION

This invention relates generally to hoods, and more particularly, to protective hoods for protecting a wearer against severe weather.

OBJECTS AND ADVANTAGES

The object of this invention is to design a hood to protect the wearer in severe weather and provide a good eyesight and breath from nose and mouth at the same time.

SUMMARY OF THE INVENTION

This invention provides a hood with three groups of connectors positioned in a triangle shape along the opening edge of the hood that surrounds the face of the user.

Two groups of connectors are positioned at above the eye or near the eye level of the wearer, on the left side and the right side. One group of connectors is positioned just under the chin of the wearer. By tightening/un-tightening one or more groups of connectors, the perimeter length of the opening edge of the hood surrounding the face area are reduced/enlarged, thus, the exposure area of the face can be adjusted, and, good eyesight and breath from the nose and the mouth in maintained at the same time.

DETAILED DESCRIPTION OF THE PREFERRED EMBODIMENT

This invention relate to a kind of garment having a body of the garment 10, a hood 11, and three groups of connectors on and around the opening edge 17 of the hood wherein the opening edge is the edge that surrounds the face of the user of the hood.

Each group of the three groups of connectors is located at a vertex of a triangle shape in relative spatial position.

The first group of connectors 15*a* and 15*b* is located in the vertex that is just under the chin of the user, the second group of connectors 16*a* and 16*b* is located at the vertex that is on the left side of the face of the user, and the third group of connectors 16*a* and 16*b* is located at the vertex that on the right side of the face of the user.

Each group of connectors includes one pair or more than one pair of connectors, with each pair of connectors having one male connector and one female connector. The male connector 15*a*, 16*a* can only be connected to the female connector 15*b*, 16*b* of its own pair.

In the first group of connectors 15*a* and 15*b*, the male connectors 15*a* and the female connectors 15*b* are on a different side of the edge of the hoodie. If the male connectors are on the left side, the female connectors must be on the right side. The male and the female connectors must cross over from left to right in order to be connected together.

In the second group (or third group) of connectors 16*a* and 16*b*, the male connectors 16*a* and the female connectors 16*b* are on the same side of the edge of the hoodie. If the male connectors are on the left side (or right side), the female connectors must be on the same side with the male connector. The male and the female connectors do not cross over from left to right in order to be connected together.

Figure 1:
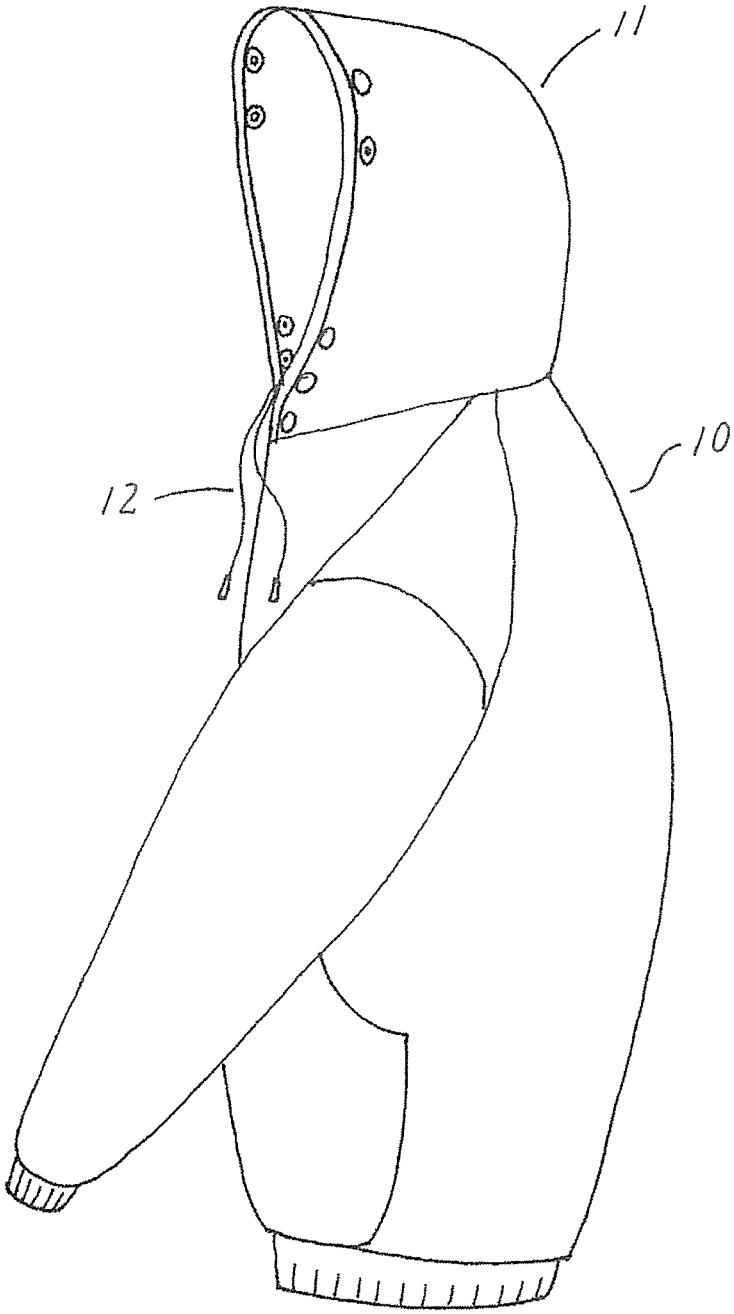
FIG. 1 is an elevation view of THE HOODIE WITH THREE GROUPS OF CONNECTORS ON THE OPENING EDGE OF THE HOOD.
Figure 2A:
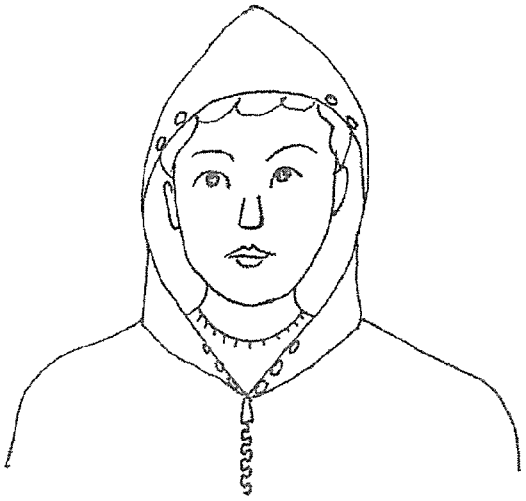
FIG. 2A shows the hoodie on head but not tightened.
Figure 2B:
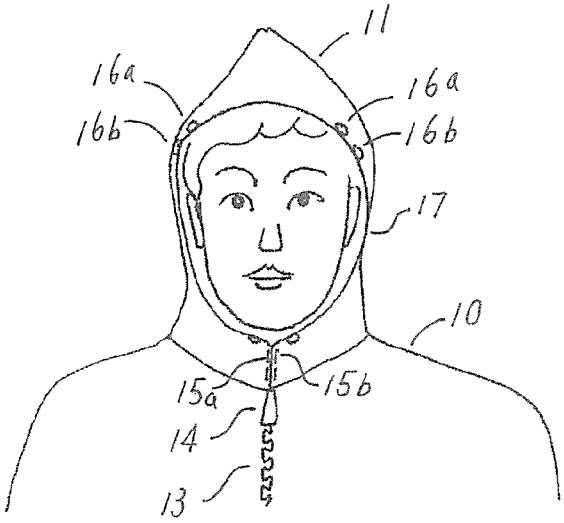
FIG. 2B shows the hoodie on head with neck part tightened.
Figure 2C:
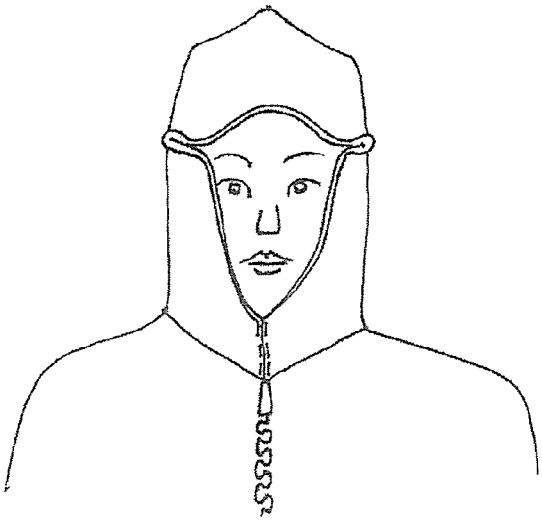
FIG. 2C shows the hoodie on head and fully tightened.
Figure 3:
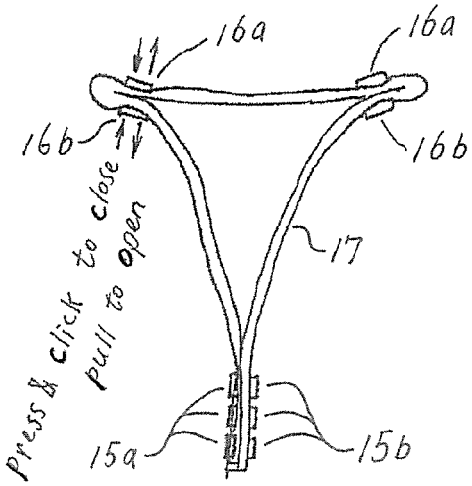
FIG. 3 shows connectors around the opening edge of the hood in a closed position.
Figure 5:
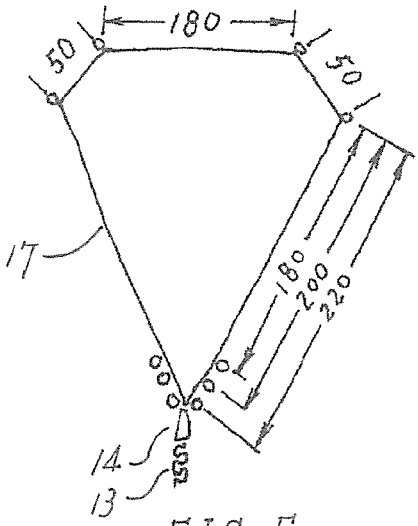
FIG. 5 shows the typical positions of connectors around the opening edge of the hoodie. (The length unit is in milimeters)
Figure 4:
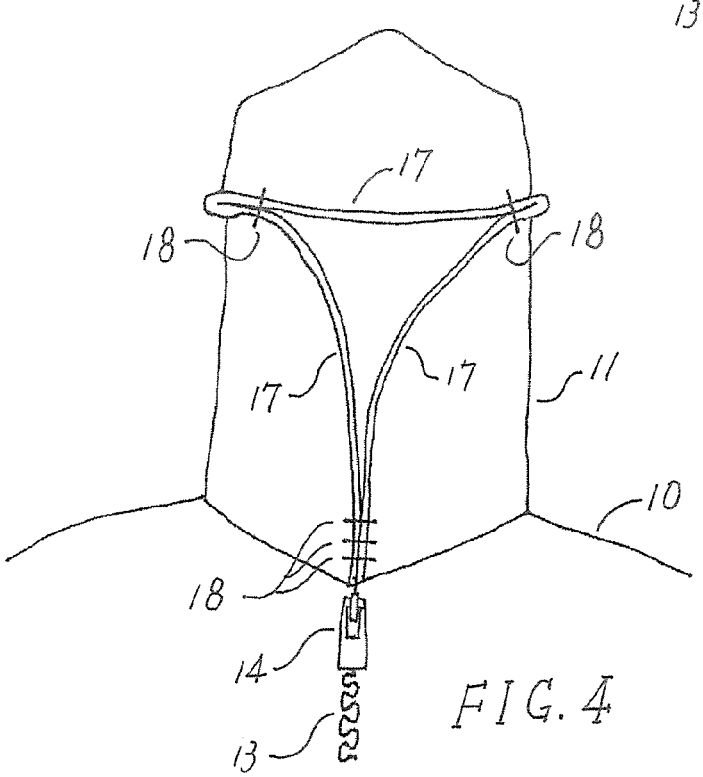
FIG. 4 shows the connection force axis positions when connectors are closed.

The connection force axis 18 positions shown in FIG. 4 clearly indicates the position of the connectors. The zipper slider 14 is not a secure means to keep the upper end of the zipper 13 in a closed condition. The quality of the first group of connectors is therefore critical.

The hood 11, can be made with or without the traditional "drawstring" 12.

The hood 11 can be put on the head of the user to cover the head, the neck and part of the face when needed by the user.

The hood 11, when it has been put on the head of the user, can be tightened/untightened by closing/opening one pair or more than one pair of connector(s) around the edge of the hood, so that the opening area around the face of the user is reduced/enlarged by direct closing/opening or by folding/unfolding the edge of the hood.

The connectors can be made of different forms and different material, and they can be of, include but not limited to snap fasteners, buttons, buckles, etc.

The connectors on the hood 11 should be made to have sufficient connection force to connect two parts of the cloth together tightly when the connectors are closed. The connectors should be able to be opened only by enough hand force.

The connectors on the hood 11 should be made of material that is durable and strong enough to withstand repeated on and off operations without decrease in functionality and deformation in shape.

When the hood 11 is tightened, the user has unobstructed vision.

When the hood 11 is tightened, it does not block the steam from the mouth and nose of the user.

The hood 11 can be attached to the body of the clothing 10 by zippers, or by buttons, or by snap fasteners, or by other means of connection, or permanently sewn to the body of the article of clothing.

The hood 11 may be made with a sweater, or with a suit jacket, or with other clothing.

The invention claimed is:

1. An article of clothing for protecting an individual in severe weather while providing unobstructed vision, said article of clothing comprising:

a body portion for covering a torso of an individual;

a hood portion mounted on the body portion for covering a head of the individual and defining an opening for a face of the individual;

the hood having three groups of connectors spaced around the opening, each of three groups of connectors being separately connectable to reduce a size of the opening around a mouth, a nose and eyes of the face, two of the three groups of connectors being located on opposed lateral sides of the opening, each of the three groups of connectors being located at a vertex of a triangle shape in relative spatial position, a first one of the three groups of connectors being located at one vertex of the triangle shape under a chin of the individual, a second one of the three groups of connectors being located at the vertex of the triangle shape on a left side of the face of the individual, and a third one of the three groups of connectors being located at the vertex of the triangle shape on a right side of the face of the individual, the three groups of connectors being connectable to define a triangular opening with at least two of the three sides of the triangle being equal and defining a reduced size opening thereby exposing an unobstructed view to the eyes of the individual and an unobstructed view through the opening while reducing exposure to the mouth of the individual, and while still having at least a portion of the mouth and the nose of the individual exposed through the opening, the two groups of connectors located on the opposed lateral sides of the opening being connected along a vertically extending connection force axis to position an upper opening edge of the opening from a round shape to a horizontally extending shape across a top of the eyes.

2. The article of clothing as claimed in claim 1, wherein each group of the three groups of connectors includes at least one pair of interengaging portions, each pair of interengaging portions includes one male interengaging portion and one female interengaging portion.

3. The article of clothing as claimed in claim 2, wherein the first one of the three groups of connectors is located on different side edge portions of the hoodie so that the female connector interengaging portion is located on one side edge portion and the male connector interengaging portion is located on an opposite side edge portion.

4. The article of clothing as claimed in claim 2, wherein the male connector interengaging portion and the female connector interengaging portion of both the second one and the third one of the three groups of connectors are located on a same side edge portion, respectively.

* * * * *